US005534889A

United States Patent [19]

Reents et al.

[11] Patent Number: 5,534,889

[45] Date of Patent: Jul. 9, 1996

[54] CIRCUIT FOR CONTROLLING BIAS VOLTAGE USED TO REGULATE CONTRAST IN A DISPLAY PANEL

[75] Inventors: Daniel B. Reents, Spring; Patrick R. Cooper, Houston; James H. Garrett, Spring; Philip J. McKenzie, Houston, all of Tex.

[73] Assignee: Compaq Computer Corporation, Houston, Tex.

[21] Appl. No.: 119,422

[22] Filed: Sep. 10, 1993

[51] Int. Cl.[6] ..... G09G 5/00

[52] U.S. Cl. ..... 345/132; 345/148

[58] Field of Search ..... 395/112, 128; 348/552, 554, 441, 673; 359/85, 86; 345/132, 148

[56] References Cited

U.S. PATENT DOCUMENTS 4,642,690 2/1987 Hinn ..... 348/673
4,649,432 3/1987 Watanabe et al. ..... 345/148 X
4,905,167 2/1990 Yamaoka et al. ..... 348/554 X
4,926,166 5/1990 Fujisawa et al. .
4,991,023 2/1991 Nicols ..... 348/554
5,406,308 4/1995 Shiki ..... 345/132 X

FOREIGN PATENT DOCUMENTS 1015841 10/1991 WIPO ..... 345/132

*Primary Examiner*—Ulysses Weldon
*Attorney, Agent, or Firm*—Pravel, Hewitt, Kimball & Krieger

[57] ABSTRACT

A liquid crystal display (LCD) panel which has its contrast controlled through the use of a pulse width modulation (PWM) circuit contained in the video controller and a contrast control circuit. In response to a particular video refresh mode, the PWM circuit modulates the pulse width of a signal that is an input to the contrast control circuit. The pulse width is changed by the use of a base contrast register and two offset registers. Depending on the video mode, the base register is used alone or is combined with one of the offset registers to provide a signal to indicate the duty cycle of the signal. The pulse width modulated signal is converted to a DC bias contrast voltage which is provided to the LCD panel.

24 Claims, 7 Drawing Sheets

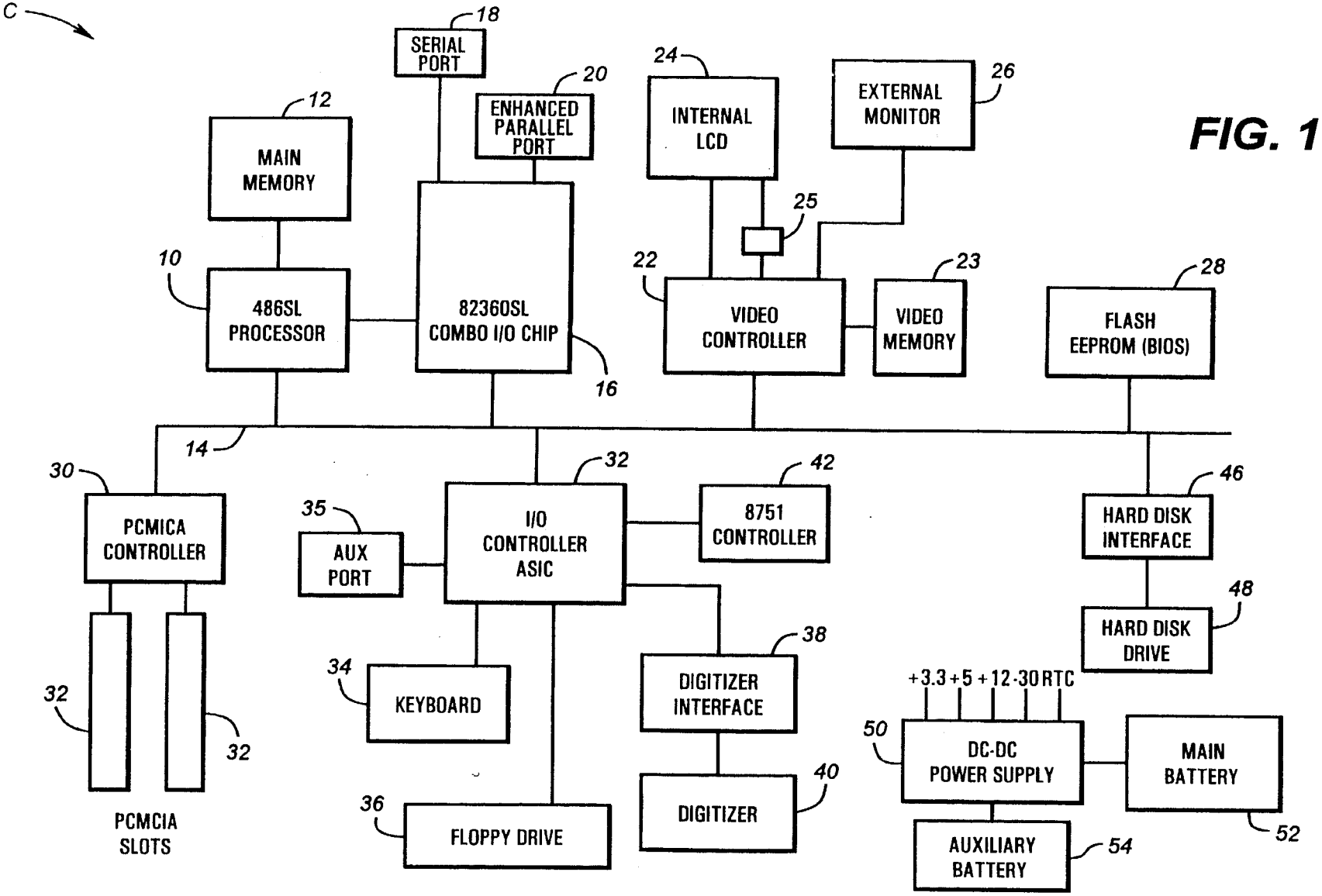
FIG. 1
C
MAIN MEMORY
12
486SL PROCESSOR
10
SERIAL PORT
18
ENHANCED PARALLEL PORT
20
82360SL COMBO I/O CHIP
16
INTERNAL LCD
24
25
EXTERNAL MONITOR
26
VIDEO CONTROLLER
22
VIDEO MEMORY
23
FLASH EEPROM (BIOS)
28
14
PCMICA CONTROLLER
30
32
32
PCMCIA SLOTS
AUX PORT
35
I/O CONTROLLER ASIC
32
8751 CONTROLLER
42
KEYBOARD
34
FLOPPY DRIVE
36
DIGITIZER INTERFACE
38
DIGITIZER
40
HARD DISK INTERFACE
46
HARD DISK DRIVE
48
+3.3 +5 +12 -30 RTC
DC-DC POWER SUPPLY
50
MAIN BATTERY
52
AUXILIARY BATTERY
54

CIRCUIT FOR CONTROLLING BIAS VOLTAGE USED TO REGULATE CONTRAST IN A DISPLAY PANEL

SPECIFICATION

BACKGROUND OF THE INVENTION

1. Field of the Invention

This invention relates to the control of the contrast on liquid crystal display (LCD) panels, and more particularly to the control of a contrast bias voltage used to regulate the contrast on the LCD panel.

2. Description of the Related Art

While the portability of laptop computers is advantageous in many instances, they are often used connected to external VGA CRT monitors, which run in various modes. The raster-scan monitors presently used are volatile, and thus an entire frame must be refreshed at a repetition rate above the flicker level of the human eye. In the United States, the standard for the minimum repetition rate is set at 60 Hz per frame to avoid flicker. The frame consists of horizontal scan lines that are scanned one line at a time, generally from the top of the screen down to the bottom. VGA modes utilize two possible frame sizes: 449 scan lines per frame for lower resolution modes or 525 scan lines per frame for higher resolution modes. In addition, the laptop computer runs its internal LCD panel using 480 horizontal scan lines per frame. As a result, there are three possible refresh modes that the video controller must be able to handle: the 449-line mode, the panel-only 480-line mode, and the 525-line mode. In laptop computers, the panel-only 480-line mode is the optimum mode; because the LCD panel is typically organized into two vertical halves, each half will have 240 lines in the 480-line refresh mode. No additional lines are needed to handle the vertical retrace period present on raster scan monitors. However, current laptop computers can display simultaneously on the internal LCD panel and the external monitor. Because of the nature of the external monitor, the internal LCD panel must be run at the same scan rates as the external monitor, even though a maximum of 480 lines can be displayed. For the two monitor refresh modes, the number of lines in each half of the LCD panel is then organized unevenly. In the 449-line mode, the top half contains 224 lines, and the bottom half contains 225 lines. In this mode there are blank areas at the top and the bottom of the LCD panel. In the 525-line mode, the top half contains 240 lines, and the bottom half is provided 285 lines but displays only 240 lines.

Thus, in the 449-line mode, the vertical scan rate decreases from the LCD 480-line scan rate. Furthermore, 49 of the 449 horizontal scan lines are dedicated to the vertical refresh period in the case of the CRT monitor. Therefore, there are only 400 active lines scanned. As a result, 40 lines in the top half and 40 lines in the bottom half of the LCD panel are left blank. In the case of the 525-line mode, 45 horizontal lines are dedicated to the vertical retrace period, leaving 480 active lines. In this mode, the scan rate increases to account for the extra lines, but those extra lines are dropped off at the end of the 480-line frame.

In VGA, the total horizontal scan period stays constant as the number of horizontal scan lines changes. This means that the vertical scan rate changes as the number of scan lines changes. The rate is lower when the number of lines is greater. The change in the vertical rate along with the change in the number of lines means that the effective duty cycle of each scan line changes. The percentage of time that a single line is being driven on the LCD panel is lower as the number of lines increases. This time difference causes the contrast perceived by the user to change as the output modes are changed. The change is noticeable in the common cases and so is a source of annoyance.

Typically, this problem is remedied by adjusting the manual contrast controls, but this is time consuming and requires activity on the part of the user increasing the annoyance. The contrast variation problem can not simply be fixed in software by modifying the video driver in the video BIOS. It would seem that the driver could simply change the contrast setting on controllers having software selectable contrast. However, because many programs circumvent the video driver in the video BIOS, a video driver solution is not a complete solution. Therefore it is desirable to have a video controller which automatically adjusts contrast settings as video modes are changed.

SUMMARY OF THE PRESENT INVENTION

According to the current invention, a pulse width modulation (PWM) control circuit having a base register and a plurality of offset registers is used in combination with the video mode register and the contrast control circuit. The mode register is used to indicate a particular video refresh mode that the system is using. The PWM control circuit contains three registers: a base contrast register and two offset registers. The offset registers are provided to change the value in the base register dependent on the video mode setting as indicated by the mode register. The resultant value is used to determine the pulse width of an output signal from the PWM control circuit. The pulse width modulated signal from the PWM control circuit is fed into a contrast control circuit, which converts the modulated signal into a DC bias contrast voltage. The magnitude of the bias control voltage is dependent upon the pulse width of the modulated signal. By controlling the bias contrast voltage in this manner, the contrast on the display panel is automatically adjusted when a different video mode is employed.

BRIEF DESCRIPTION OF THE DRAWINGS

A better understanding of the present invention can be obtained when the following detailed description of the preferred embodiment is considered in conjunction with the following drawings, in which:

FIG. 1 is a computer system employing the preferred embodiment of the present invention;

DETAILED DESCRIPTION OF THE PREFERRED EMBODIMENT

Figure 2:
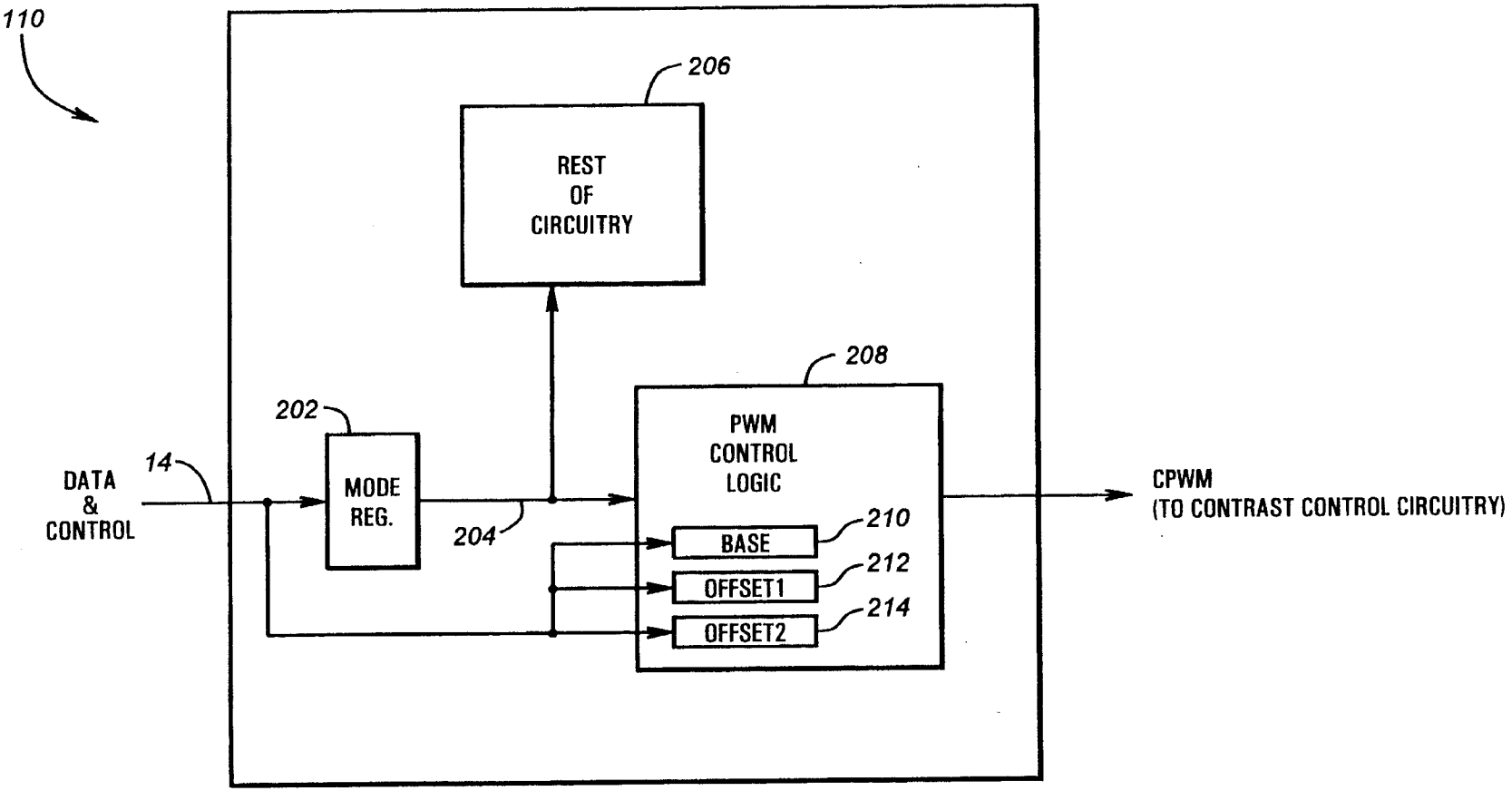
FIG. 2 is the relevant logic circuitry inside a video controller.

Referring now to FIG. 1, a computer C according to the present invention is shown. A microprocessor 10, preferably the 486SL processor from Intel Corporation (Intel), forms the main computing element of the computer C. Main memory 12 is connected to the processor 10 over a memory bus. A bus 14 is connected to the processor 10 and includes address, data and control portions to form a main communication bus to the various components in the computer system C. One such component is a combination I/O chip 16, preferably the 82360SL from Intel. A separate connection preferably is made between the processor 10 and the combo I/O chip 16 to provide the special connections between the 486SL and the 82360SL. A serial port 18 and an enhanced parallel port 20 are provided from the combo I/O chip 16. A video controller 22 is connected to the bus 14 to receive commands from the processor 10 and video memory 23 is connected to the video controller 27. An internal liquid crystal display (LCD) panel 24 is connected to the video controller 22 and in certain cases an external monitor 26, typically a CRT, can be connected to the video controller 22 as desired. A contrast control circuit 25 is connected to the video controller 22 and to the internal LCD panel 24. The contrast control circuit 25 adjusts the contrast of the internal LCD panel 24 in response to different video modes. The LCD panel 24 can be one of many suitable VGA-compatible LCD panels.

As the computer system C must contain certain basic operating routines to allow the computer to boot and to perform certain fundamental system functions, these routines being generically referred to as the BIOS, a flash EEPROM 28 is connected to the bus 14. A PCMCIA controller 30 is connected to the bus 14 and in turn has two PCMCIA slots 32 connected to it. The PCMCIA slots 32 provide expansion capabilities for the computer system C to provide additional memory if desired or to receive certain communications options, such as modems and network cards.

An I/O controller application specific integrated circuit (ASIC) 32 is connected to the bus 14. The I/O controller ASIC 32 provides numerous special functions in the computer C. One of those is to provide keyboard scanning logic to allow direct scanning of a keyboard 34 so that a separate controller is not required. The I/O controller ASIC 32 contains the necessary shift registers and clock logic to allow connection of a pointing device to an auxiliary port 35. In addition, the I/O controller ASIC 32 contains the necessary interfaces to connect to a floppy drive 36 and to a digitizer interface 38. The digitizer interface 38 is in turn connected to a digitizer 40 to allow pen input information to be utilized in the computer system C. The I/O controller ASIC 32 also preferably includes various registers to allow it to be used in combination with an 8051 or 8751 microcontroller 42. When used with an 8751 controller 42, the I/O controller 32 appears to the processor 10 as an 8042-type microcontroller as commonly used as a keyboard controller in a conventional desktop personal computer. Thus the I/O controller ASIC 32 contains certain elements to mimic the register set and which are accessible by the 8751 controller 42. In this manner the 8751 controller 42 need not perform many of the actual conventional 8042 keyboard controller low level functions, such as the keyboard and aux port serial communications, as these functions are done in the I/O controller ASIC 32 to relieve the burdens on the 8751 controller 42.

A hard disk interface 46 is also connected to the bus 14 to allow the processor 10 to interface with a hard disk drive 48 for mass storage.

The computer C also includes a power supply. A DC/DC power supply 50 provides the necessary voltages used in the computer C, such as +3.3, +5, +12, −30 and a voltage provided to the CMOS memory 17 and the RTC 19. The CMOS/RTC voltage is provided separately to allow the remaining components of the computer C to be powered off to allow the computer C to be placed in a very low power standby condition. The DC/DC power supply 50 is connected to a main battery 52 of the computer C and a small auxiliary battery 54.

Referring now to FIG. 2, portions of the video controller 22 are shown. Data and control signals are input into the video controller card 22 from the data and control bus 14. A mode register 202 specifies one of three possible refresh modes. It is understood that the mode register conventionally found in VGA-compatible video controllers is simplified for this explanation. The output of the mode register 202 is connected to PWM control logic 208 and to the rest of the circuitry 206 located in the video controller card 22. The PWM control logic 208 contains a base contrast register 210, an offset1 register 212 and offset2 register 214. These registers 210, 212 and 214 are loaded from the data and control bus 14. A contrast setting is obtained from the contents of the base contrast register 210, the offset1 register 212, and the offset2 register 214 as explained below. The contrast setting is different for different video modes depending on the number of scan lines, and the method of obtaining this contrast setting is described below. The PWM control logic 208 uses the contrast setting to modulate the pulse width of an output signal CPWM, which is provided as an input to the contrast control circuit 25.

Figure 3:
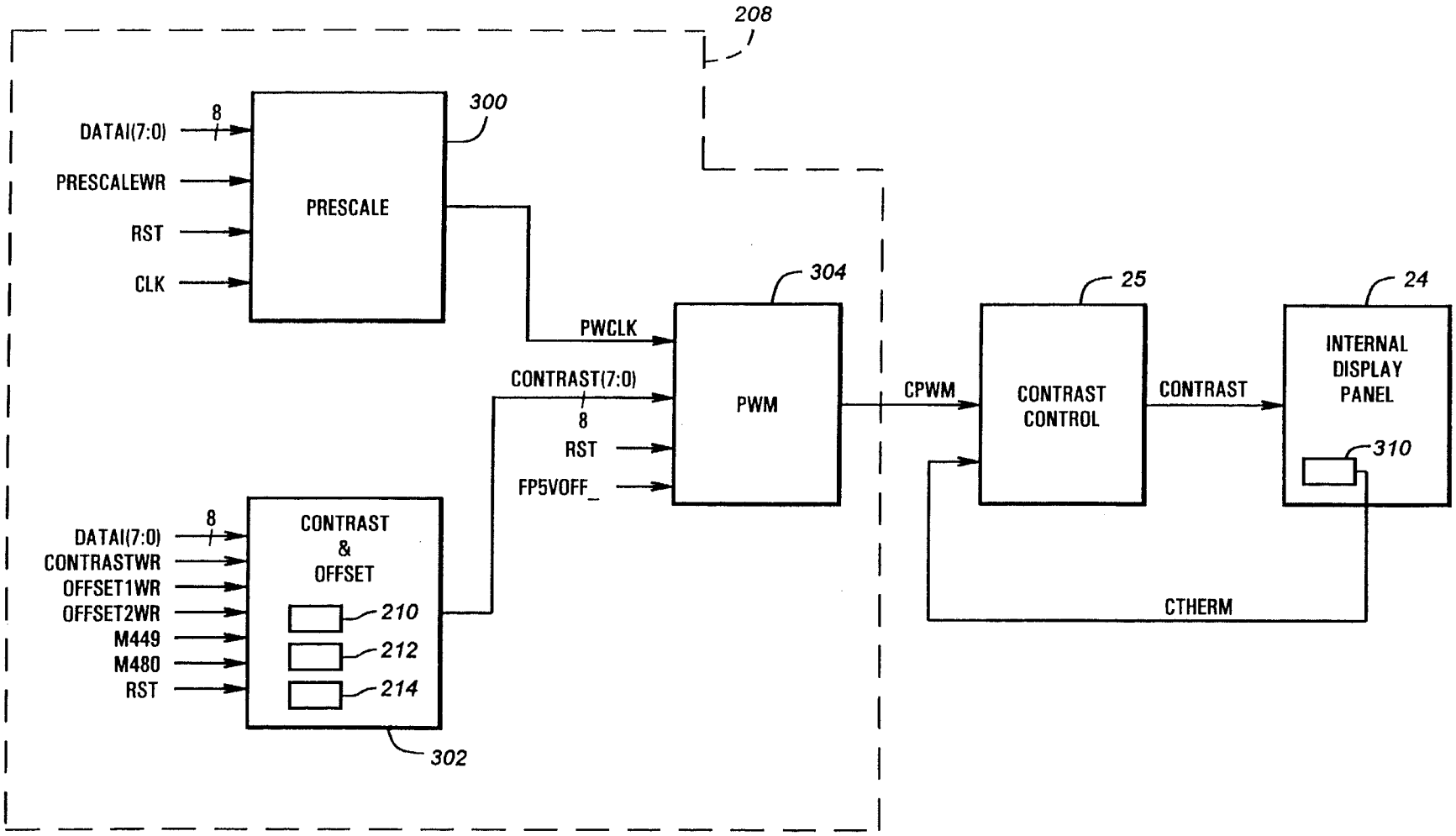
FIG. 3 is a block diagram of the PWM control logic of FIG. 2 and the contrast control circuit and the display panel of FIG. 1.

Referring to FIG. 3, the PWM control logic 208 is shown connected to the contrast control circuit 25. The contrast control circuit 25 is connected to the internal LCD panel 24. A prescale circuit 300 outputs a clock PWCLK to a PWM circuit 304. A contrast and offset block 302 provides the contrast setting for the PWM circuit 304, which generates the modulated signal CPWM in response to the contrast setting. The contrast control circuit 25 converts the modulated signal CPWM generated by the PWM circuit 304 into a DC bias voltage CONTRAST, which regulates the contrast of the internal LCD panel 24. The bias voltage CONTRAST varies with the magnitude of the modulated pulse width of the signal CPWM. A thermistor 310 is located in the internal display panel 24 to monitor the temperature of the display panel 24 and convert the temperature to a resistance from CTHERM to CONTRAST. The change in resistance from CTHERM to CONTRAST causes the contrast control circuit 25 to adjust the bias voltage CONTRAST.

A prescale value is loaded into the prescale circuit 300 by a bus DATAI(7:0) on the falling edge of a signal PRESCALEWR. The frequency of a clock CLK is decreased by a factor of the prescale value plus one, and outputted from the prescale circuit 300 as a clock PWCLK. The clock PWCLK is an input to the PWM circuit 304.

In the preferred embodiment the clock CLK has a frequency of approximately 1 MHz and a value of 00h is loaded as the prescale value. Base contrast and offset values are loaded from the bus DATAI(7:0) into the base contrast register 210, offset1 register 212, and offset2 register 214 located in the contrast and offset block 302. The state of the bus DATAI(7:0) is loaded into the base contrast register 210 on the falling edge of a signal CONTRASTWR, into the offset1 register 212 on the falling edge of a signal OFFSET1WR, and into the offset2 register 214 on the falling edge of a signal OFFSET2WR. Preferably these registers 210, 212 and 214 are located at predetermined addresses, with the address decode logic not being illustrated for simplicity. A signal M449 denotes a 449-line refresh mode, and a signal M480 denotes a 480-line refresh mode. These signals M449 and M480 are provided by the mode register 202 based on the selected video mode. If the signal M449 is asserted, the contents of the base contrast register 210 are used as the contrast setting, which is outputted onto a bus CONTRAST(7:0) by the contrast and offset block 302. If the signal M480 is asserted, the contents of the offset1 register 212 are added to or subtracted from the contents of the base contrast register 210 to obtain the contrast setting. Otherwise, if neither of the signals M449 or M480 are asserted, the contents of the offset2 register 214 are added to or subtracted from the contents of the base contrast register 210. The method of selecting an addition or subtraction is described later. The bus CONTRAST(7:0) in combination with the clock PWCLK determines the pulse width modulation of the signal CPWM. If a system enable signal FP5VOFF_ is low, that indicates that the internal LCD panel 24 is off, and as a result, the signal CPWM is forced low. A system reset signal RST is input to the prescale circuit 300, the contrast and offset block 302 and the PWM circuit 304; on the rising edge of the signal RST, the circuits are initialized to their initial conditions.

Figure 4:
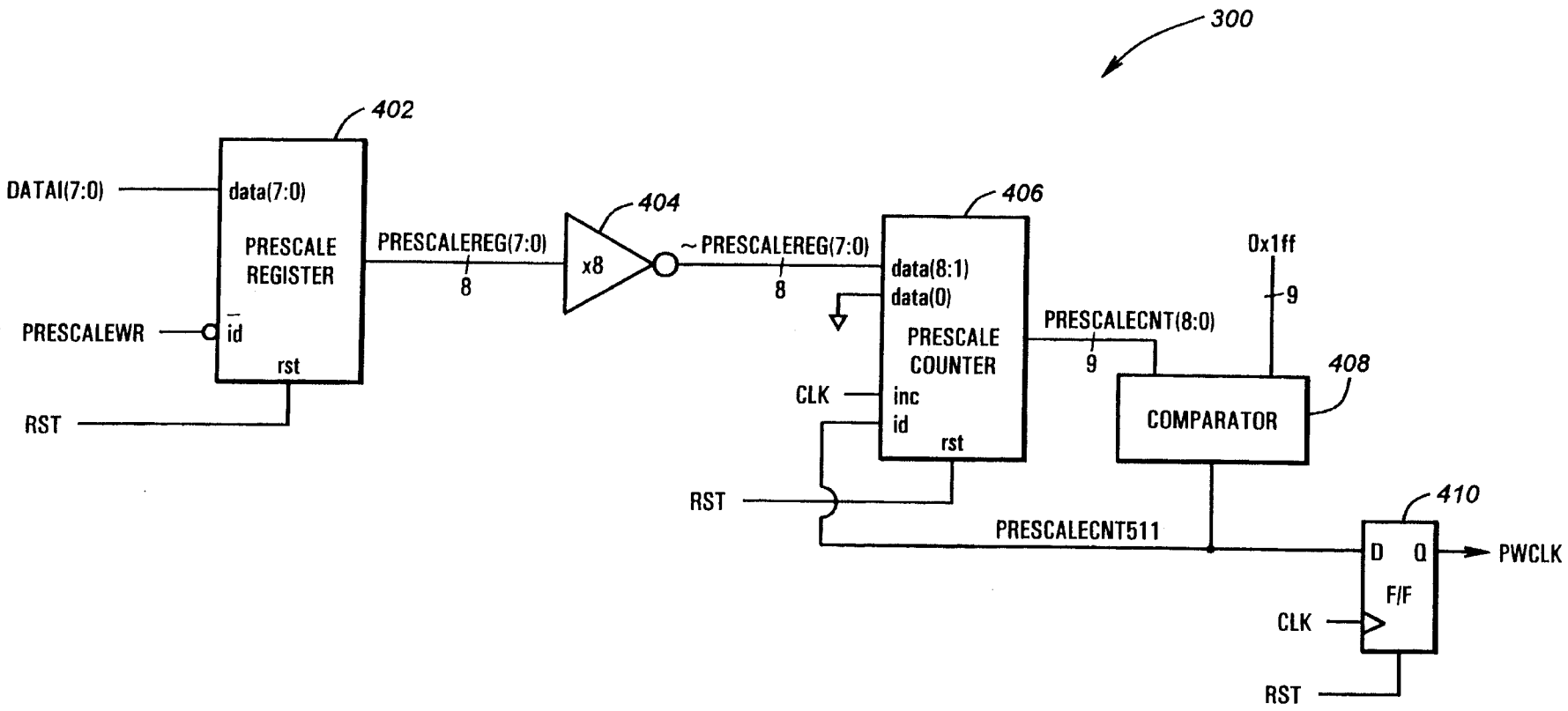
FIG. 4 is a schematic block diagram of the prescaling circuit of FIG. 3.

Referring to FIG. 4, the internal logic of the prescale circuit 300 is shown. The prescale circuit 300 includes a prescale register 402 driving a bank of eight inverters 404 by means of a bus PRESCALEREG(7:0). The prescale value is loaded into the prescale register 402 by the bus DATAI(7:0) on the falling edge of PRESCALEWR, which is a decoded and qualified strobe indicating an access by the microprocessor 20 to the prescale register 402. On the rising edge of RST, the prescale register is reset to zero. Each bit of the bus PRESCALEREG(7:0) is inverted by the bank of inverters 404. The outputs of the bank of inverters 404 drive a bus ~PRESCALEREG(7:0), which is input into a prescale counter 406. The prescale counter 406 is a 9-bit binary counter that is incremented by the clock CLK. The most significant 8 bits of the prescale counter 406 are initialized to the state of the bus ~PRESCALEREG(7:0), and the least significant bit of the prescale counter 406 is initialized to the value zero. Thus, the prescale counter 406 counts from the value {~PRESCALEREG(7:0), 0} to the value 511. On the rising edge of the reset signal RST, the prescale counter 406 is reset to the initial value of 511. The output of the prescale counter 406 is driven onto a bus PRESCALECNT(8:0), which is compared to the value 511 by a comparator 408. If a match occurs, then a signal PRESCALECNT511 is asserted high by the comparator 408. The signal PRESCALECNT511 is fed back to the load input of the prescale counter 406 to reload the counter to its initial condition, which is the value {~PRESCALEREG(7:0), 0}. The signal PRESCALECNT511 is also input to the D input of a D flip-flop 410. On the rising edge of the clock CLK, the state of PRESCALECNT511 is latched into the D flip-flop 410. The output of the D flip-flop 410 is the clock PWCLK, which feeds into the PWM circuit 302 described below. On the rising edge of the reset signal RST, the D flip-flop 410 is reset to a low state. The cumulative result of the functions described above is that the signal PWCLK is pulsed high once every 512 {~PRESCALEREG(7:0), 0} CLK clock cycles, which is equivalent to multiplying the period of the clock CLK by the factor of 2×[PRESCALEREG(7:0) +1]. For example, if the prescale value is the decimal value 2 (binary representation is equal 00000010), then its inverted value is 253 (binary representation is equal 11111101). By concatenating a zero to the LSB of the value 253, the value 506 results. The clock PWCLK is thus pulsed once every 6 CLK cycles, which is equivalent to multiplying the period of the clock CLK by a factor of 6.

Figure 5:
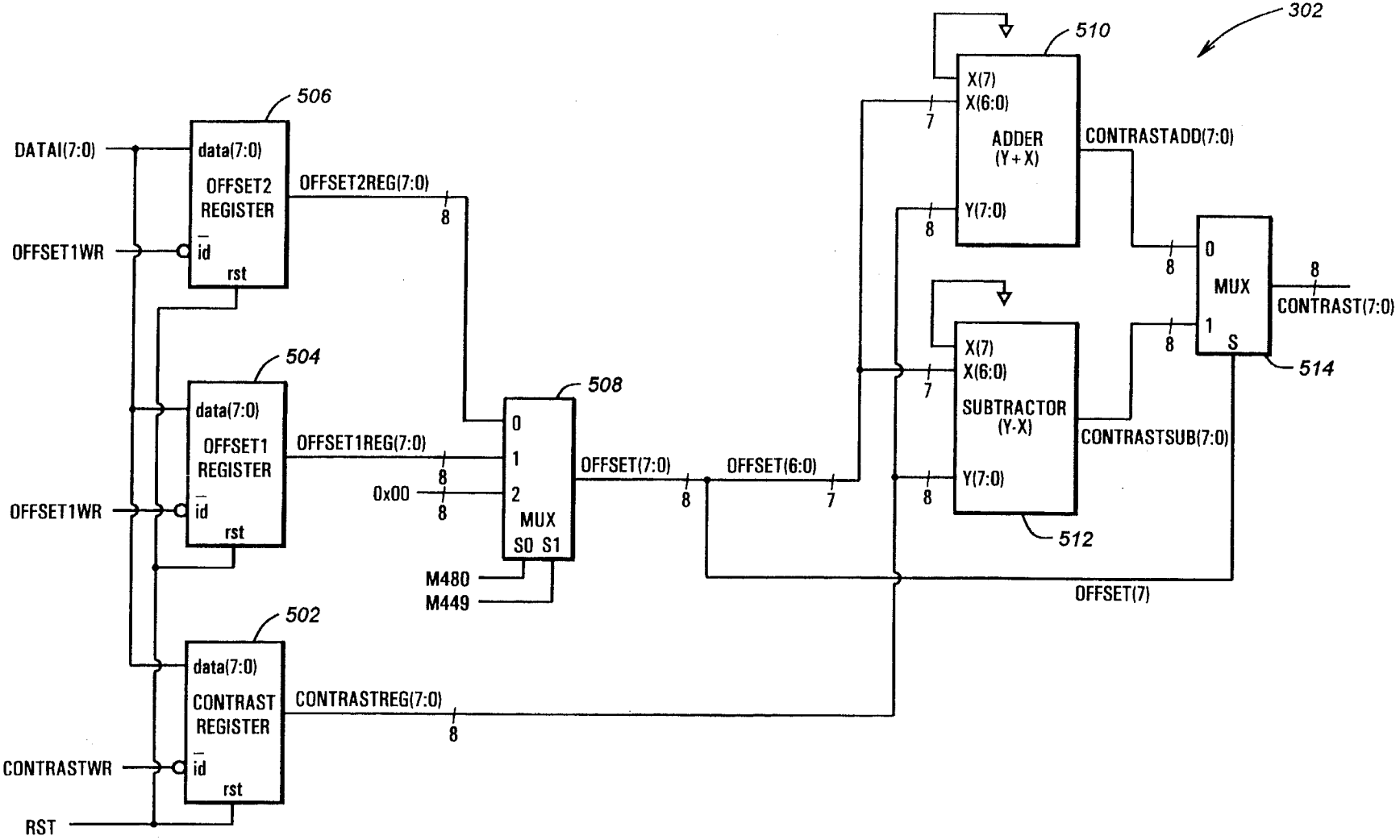
FIG. 5 is a schematic block diagram of the contrast and offset registers and accompanying combinational logic of FIG. 3.

Referring to FIG. 5, a base contrast register 502, an offset1 register 504 and an offset2 register 506 are shown with the accompanying combinational logic: a multiplexer 508, an adder 510, a subtractor 512 and a multiplexer 514. The base contrast register 502, offset1 register 504 and offset2 register 506 are the logical representations of the base contrast register 210, offset1 register 212, and offset2 register 214 shown in FIGS. 3, respectively. The contrast and offset values are loaded into the registers by the bus DATAI(7:0). On the falling edge of the signal CONTRASTWR, which indicates a write to the base contrast register 210, the state of the bus DATAI(7:0) is loaded into the base contrast register 502. On the falling edge of the signal OFFSET1WR, which indicates a write to the offset1 register 212, the state of the bus DATAI(7:0) is loaded into the offset1 register 504. And similarly, on the falling edge of the signal OFFSET2WR, which indicates a write to the offset2 register 214, the state of the bus DATAI(7:0) is loaded into the offset2 register 506. When the reset signal RST rises, all three registers are initialized to zero. A multiplexor 508 is used to determine the offset value to be added to or subtracted from the contents of the base contrast register 502. The select inputs for the multiplexor 508 are the signals M449 and M480. The signal M449 denotes a 449-line refresh mode, and the signal M480 denotes a 480-line refresh mode. When the signal M449 is asserted high, the value zero is selected by the multiplexor 508 and outputted onto the bus OFFSET(7:0). If the signal M480 is asserted high, then the contents of the offset1 register 504, which are driven onto the bus OFFSETREG(7:0), are selected by the multiplexor 508 and outputted onto the bus OFFSET(7:0). If neither of the signals M449 or M480 is high, the contents of the offset2 register 506, which are driven onto the bus OFFSET2REG(7:0), are selected by the multiplexor 508 and outputted onto the bus OFFSET(7:0). After the offset has been selected, the state of the bus OFFSET(6:0) is added by the adder 510 to the contents of the base contrast register 502 as represented by the bus CONTRASTREG(7:0). Since the bus OFFSET(6:0) has one less bit than the bus CONTRASTREG(7:0), a zero is concatenated to the most significant bit of the bus OFFSET(6:0) when the addition is performed by the adder 510. In a similar fashion, the state of the bus OFFSET(6:0) is subtracted from the state of the bus CONTRASTREG(7:0) by the subtractor 512. Again, a zero is concatenated to the most significant bit of the bus OFFSET(6:0) to perform the subtraction. The bus bit OFFSET(7) is a sign bit used to determine whether the adding operation or the subtracting operation is selected by the multiplexor 514. If the bus bit OFFSET(7) is low, then the addition is selected; otherwise, the subtraction operation is selected. The multiplexor 514 then outputs the result onto the bus CONTRAST(7:0), which represents the contrast setting.

Figure 6:
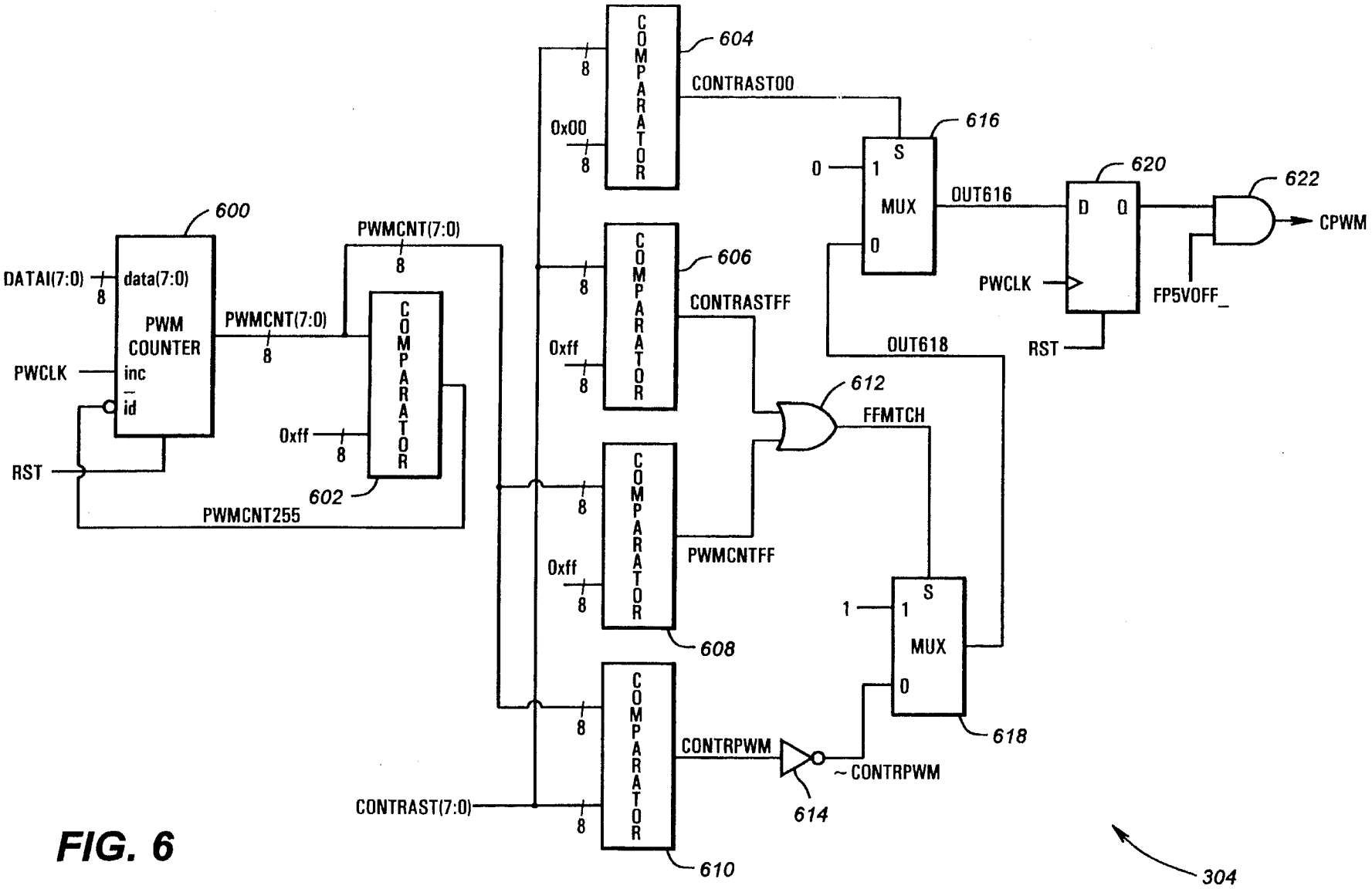
FIG. 6 is a schematic block diagram of the pulse width modulation circuit of FIG. 3.

Referring to FIG. 6, the pulse width modulation (PWM) circuit 304 is shown. The clock PWCLK from the prescale circuit 300 increments the PWM counter 600. The output of the PWM counter 600, a bus PWMCNT(7:0), is input to a comparator 602, where the bus PWMCNT(7:0) is compared to the value 255. If a match occurs, the signal PWMCNT255 is asserted high by the comparator 602. The signal PWMCNT255 feeds back to the load input of the PWM counter 600 to reload the PWM counter 600 with the value one. On the rising edge of the reset clock RST, the PWM counter 600 is reset to the value one. In effect, the PWM counter 600 counts from the value one to the value 255.

The value of the contrast setting, represented by the bus CONTRAST(7:0) is compared to the value zero in a comparator block 604. If a match occurs at the comparator block 604, the signal CONTRAST00 is asserted high. The signal CONTRAST00 is used as the select input of a multiplexor 616. If the signal CONTRAST00 is high, then a zero is selected by the multiplexor 616, which sets a signal OUT616 low; otherwise, the signal OUT616 is set to the state of a signal OUT618. If the state of the bus CONTRAST(7:0) is not equal to zero, the following comparisons are performed. The bus CONTRAST(7:0) is compared to the value 255 in a comparator block 606. If a match occurs in the comparator block 606, then a signal CONTRASTFF is asserted high. The bus PWMCNT(7:0) is compared with the value 255 in a comparator 608. If a match occurs at the comparator 608, then a signal PWMCNTFF is asserted high. The signals CONTRASTFF and PWMCNTFF are the inputs of an OR gate 612. If either of the signals CONTRASTFF or PWMCNTFF is asserted high, then the OR gate 612 drives a signal FFMTCH high. The signal FFMTCH goes to the select input of a multiplexor 618. If the signal FFMTCH is high, then a one will be selected by the multiplexor 618, and the signal OUT618 is set high; otherwise a signal ~CONTRPWM driven by an inverter 614 is selected by the multiplexor 618. If neither of the signals CONTRASTFF or PWMCNTFF is high, the comparator 610 compares the state of the bus CONTRAST(7:0) with the state of the bus PWMCNT(7:0). If the value of the bus PWMCNT(7:0) is greater than or equal to the value of the bus CONTRAST(7:0), then a signal CONTRPWM is asserted low by the comparator 610. Otherwise, the signal CONTRPWM is asserted high. It is in this manner that the duty cycle of the signal CPWM, which is the output of the PWM circuit 304, is defined by the value of the contrast setting as represented by the bus CONTRAST(7:0). The point at which the signal CONTRPWM is asserted low changes with the value of the bus CONTRAST(7:0). The signal CONTRPWM is inverted by the inverter 614, which drives the signal ~CONTRPWM. If the signal FFMTCH is low, signifying that neither the value of the bus CONTRAST(7:0) nor the value of the bus PWMCNT(7:0) is equal to the value 255, then the state of the signal ~CONTRPWM is driven onto the signal OUT618 by the multiplexor 618. If the select signal CONTRAST00 is low, then the signal OUT618 is selected by the multiplexor 616, which sets the signal OUT616 to the same state as the signal OUT618. The signal OUT616 goes to the input of a D flip-flop 620, which is clocked by the clock PWCLK. On the rising edge of the clock PWCLK, the state of the signal OUT616 is latched into the D flip-flop 620. On the rising edge of the reset signal RST, the D flip-flop is reset low. The D flip-flop drives a signal CONTRASTPWM, which is an input to an AND gate 622. The signal CONTRASTPWM is ANDed with the display system enable signal FP5VOFF*. If both signals are high, then the AND gate 622 asserts the signal CPWM high. The contrast setting CONTRAST(7:0) thus determines the point at which the signal CPWM is asserted high or low. As a consequence, a change in the value of the contrast setting CONTRAST(7:0) changes the duty cycle of the signal CPWM. For example, if the value of the bus CONTRAST(7:0) increases, the amount of time at which the signal CPWM stays high also increases; that is, the duty cycle of the signal CPWM increases.

In the preferred embodiment a value from 00h to B0h in 0Bh increments is provided to the base contrast register 210, the value 1Ch to the offset1 register 212 and the value 1Ch to the offset2 register 214. The base contrast register 210 value changes based on user selection. This then results in a duty cycle change of approximately 11% of full scale for 480 and 525 scan line modes.

Figure 7:
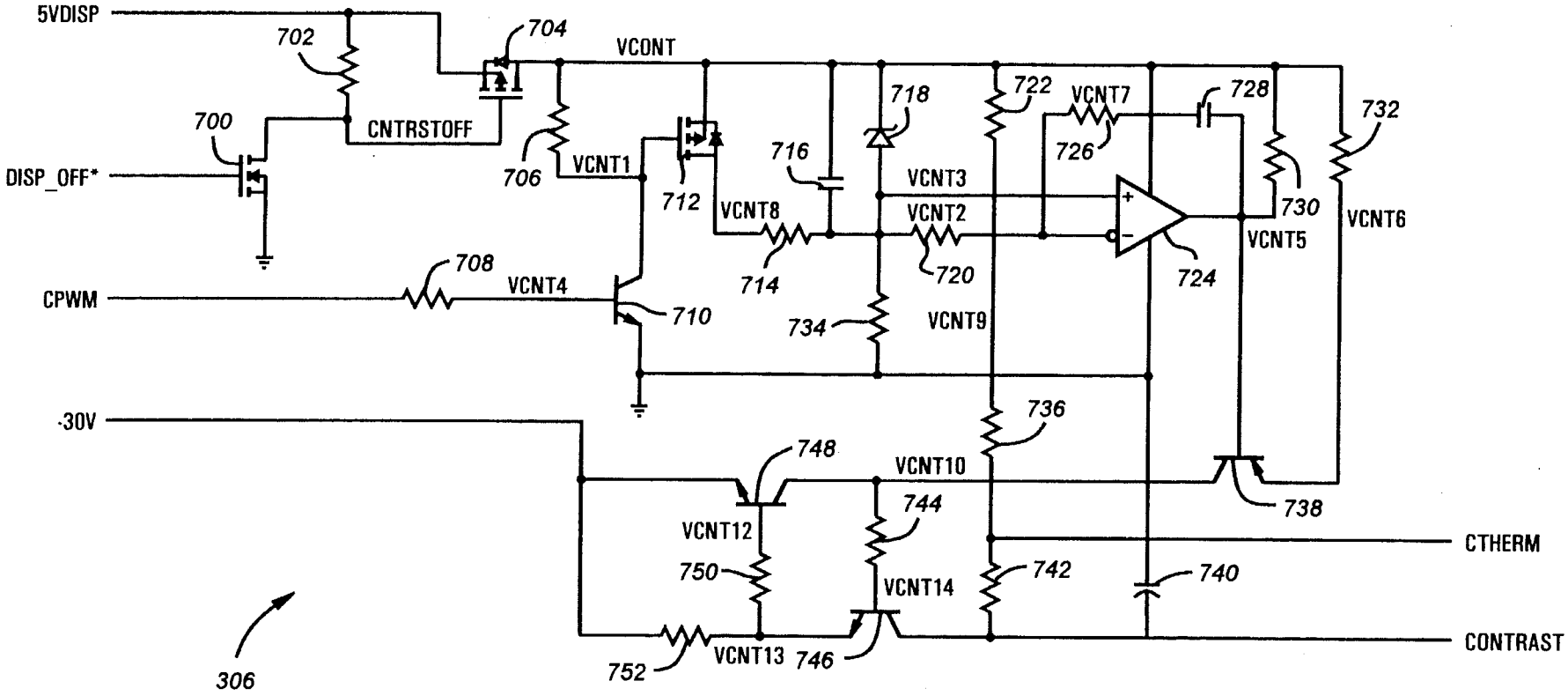
FIG. 7 is a schematic diagram of the contrast control circuit of FIG. 1.

Referring to FIG. 7, the contrast control circuit 306 is shown. An enable signal DISP_OFF* drives the gate of an N-channel MOSFET 700. The drain of the N-channel MOSFET 700 is connected to a node CONTRSTOFF, and the source of the MOSFET is connected to ground. If the enable signal DISP_OFF* is high, the node CNTRSTOFF is pulled low by the N-channel MOSFET 700. The node CNTRSTOFF is connected to the gate of a P-channel MOSFET 704. The drain of the P-channel MOSFET 704 is connected to a signal VCONT, and the source of the MOSFET is connected to a power supply voltage 5VDISP. When the signal CNTRSTOFF is pulled low, the P-channel MOSFET 704 is turned on, thereby connecting the 5-volt power supply voltage 5VDISP to the node VCONT, causing the node VCONT to rise to 5 volts. When the signal DISP_OFF* is low, the N-channel MOSFET 700 is turned off, and the node CNTRSTOFF is pulled high through a resistor 702 to the voltage of 5VDISP. The node CNTRSTOFF pulling high causes the P-channel transistor 704 to shut off, causing the node VCONT to be disconnected from signal 5VDISP; as a result the contrast control circuit 306 is disabled.

The modulated signal CPWM from the PWM circuit 304 is connected to one side of a resistor 708. The other side of the resistor 708 is connected to the base of an NPN transistor 710. The emitter of the transistor 700 is connected to ground, and its collector is connected to a node VCNT1. The node VCNT1 is connected to the gate of a P-channel MOSFET 712 and also to one side of a resistor 706. The other side of the resistor 706 is connected to the node VCONT. Thus, the NPN transistor 710 and the resistor 706 form an inverter that inverts the state of the signal CPWM onto node VCNT1. The P-channel MOSFET 712 is on when node VCNT1 is low, and it is off when node VCNT1 is high. The drain of the P-channel MOSFET 712 is connected to one side of a resistor 714, and its source is connected to node VCONT. Resistor 714, a resistor 720 and a capacitor 716 form a T network. The second side of the resistor 714 is connected to a node VCNT2. The resistor 720 is connected between node VCNT2 and the inverting input of an operational amplifier 724. The capacitor 716 is connected between nodes VCNT2 and VCONT. Preferably the capacitor 716 is a large value capacitor to act as an averaging capacitor. When the P-channel MOSFET 712 is off, the effective resistance at the drain of the MOSFET 712 and looking back through the resistor 720 is equal to the cut off resistance of the P-channel MOSFET 712, which is extremely large. If the P-channel MOSFET 712 is on, the effective resistance seen at the drain of the MOSFET 712 and looking back through the resistor 720 is equal to the value of the resistor 720, the value of resistor 714, and the value of the channel resistance of the P-channel MOSFET 712 combined. By averaging the resistance over an entire cycle of the signal CPWM, an average effective resistance is derived. The T network consisting of the resistor 714, the resistor 720 and the capacitor 716 is an averaging filter, which filters out the fundamental frequency of the pulse width modulated signal CPWM. The resistors 720 and 714 and the capacitor 716 make up a low pass filter that filters out all the high frequency elements of the input signal CPWM, allowing only the DC component of the signal CPWM to be passed through the averaging filter. As the pulse width of the modulated signal CPWM increases, the P-channel MOSFET 712 stays on for a longer period of time, causing the average effective resistance as seen from the inverting input of operational amplifier 724 looking back through resistor 720 to decrease. With a decrease in the average effective resistance, the DC time-average current flowing through the resistor 714 and the resistor 720 increases.

A voltage regulator 718 is placed between nodes VCONT and the noninverting input of the operational amplifier 724.

The voltage regulator has a reference voltage of 2.5 volts. Thus, the noninverting input of the operational amplifier 724 is regulated at a voltage equal to VCONT - 2.5 volts. A resistor 734 is connected between the noninverting input of the operational amplifier 724 and ground. The resistor 734 provides a current path from the voltage regulator 718 to ground. A resistor 722 is connected between the inverted input of the operational amplifier 724 and node VCONT. A resistor 726 and a capacitor 728 are connected between the output and the inverting input to act as a compensating circuit to prevent oscillation. A resistor 736 is connected to the inverted input of the operational amplifier 724 and one end of a resistor 742, the CTHERM signal is provided to the junction series between the resistors 736 and 742. The positive supply voltage for the operational amplifier 724 is VCONT, and the negative supply voltage for the operational amplifier 724 is ground.

A signal path exists between the output of the operational amplifier 724 and the inverting input of the operational amplifier 724. The signal path includes a PNP transistor 738, a resistor 744, an NPN transistor 746, a resistor 742 and the resistor 736. This signal path forces the voltage of the inverting input of the operational amplifier 724 to be very close to the voltage at the noninverting input of the operational amplifier 724. A slight difference between the voltages at the inverting and non-inverting inputs of the operational amplifier 724, respectively, causes the operational amplifier 724 to drive a voltage onto a its output. The voltage at the output determines the current through a resistor 730, which is connected between the output and the node VCONT. The current flowing from the output of the operational amplifier 724 and the current flowing through the resistor 730 determines the current flow into the base of the PNP transistor 738. The emitter of the PNP transistor 738 is connected to a resistor 732, which has its other end connected to the node VCONT. A base current into the PNP transistor 738 causes the transistor to function in the linear mode, and thus, a current flows from node VCONT through the resistor 732 and passes from the emitter of the PNP transistor 738 to its collector. This current flows through a resistor 744 connected between the collector of the PNP transistor 738 and the base of the NPN transistor 746. The collector of the NPN transistor 746 provides the output signal CONTRAST. The current flowing through the resistor 744 into the base of the NPN transistor 746 causes the transistor 746 to function also in the linear mode. As a result, a current flows from the collector to the emitter, which causes a current to flow through a resistor 752 that is connected between the emitter of the NPN transistor 746 and the –30 volt supply voltage provided by the power supply 50. Depending on the magnitude of the current flow through the transistor 746, the output voltage of the signal CONTRAST ranges between –16 volts and –28 volts. An NPN transistor 748, whose emitter is connected to the –30 volt supply voltage and whose collector is connected to the collector of the PNP transistor 728, acts as a current limiter. A resistor 750 is connected between the base of the NPN transistor 748 and the emitter of the NPN transistor 746. The transistor 748 is normally in its off state. However, a large current flow through the resistor 752 will cause the voltage at the emitter of the NPN transistor 746 to rise with respect to the –30 volt supply voltage, which can cause the base-emitter junction of the transistor 748 to forward bias and thereby turn the transistor 748 on. When the transistor 748 turns on, part of the current flowing from the collector of the transistor 738 is shunted through the transistor 748. As a result, the amount of current flowing into the base of the transistor 746 is limited, thus limiting the current that can flow into the collector and out of the emitter of the NPN transistor 746. The transistor 748 thus acts to limit the current flow through the transistor 746.

The resistor 742 is connected between the collector of the NPN transistor 746 and the resistor 736. Thus the resistor 742 is between the signal output voltage CONTRAST and the signal CTHERM, which is the output of the thermistor 310 located in the internal LCD panel 24. The thermistor 310 monitors the temperature at the LCD panel 24 and converts that temperature to a corresponding resistance. A shift in the temperature then causes a shift in the resistance from CONTRAST to CTHERM. This causes the current flowing through the resistor 742 to change, and as a result, the output voltage CONTRAST changes.

When the time-average current through the resistor 714 and the resistor 720 changes as a result of a change in the duty cycle of the pulse width modulated signal CPWM, the current through the resistor 736 and the resistor 742 changes accordingly to keep the inverting input of the operational amplifier 724 at a constant voltage. The change in current flow through the resistor 736 and the resistor 742 causes the current flowing into the collector of the NPN transistor 746 to change. Consequently, the current flowing through the resistor 752 changes, thereby causing a shift in the output voltage CONTRAST. A capacitor 740 connected between the output voltage CONTRAST and ground acts to filter out high frequency noise elements on the output voltage CONTRAST.

In summary, the operational amplifier 724 functions to force its inputs to be as close in voltage as possible. A slight difference in the voltage levels at the inputs causes the operational amplifier 724 to amplify a voltage onto its output, thereby turning the PNP transistor 738 on. This causes a current flow out of the collector of the transistor 738 and into the base of the NPN transistor 746, causing it to function in the linear mode. The resulting current flow through the transistor 746 and the resistor 752 acts to maintain the output voltage CONTRAST at a desired level. The T-network comprising the resistor 714, the resistor 720, and the capacitor 716 converts the pulse width modulated signal CPWM to a DC time-average current. This current changes with the pulse width of the signal CPWM. The change in current causes the output voltage CONTRAST to also change correspondingly, thereby adjusting the contrast at the display panel 308. The output voltage CONTRAST is also changed with a change in the resistance of the thermistor connected between CTHERM and CONTRAST, which changes with the temperature at the display panel 24.

Thus a system according to the present invention, particularly the preferred embodiment, provides a means to automatically change the contrast setting on an LCD panel when changing between various video modes. Once the various registers are programmed, when the video mode is changed, the contrast also changes if appropriate. Thus is done without special driver software which could be bypassed and without manual user adjustment of the contrast setting.

The foregoing disclosure and description of the invention are illustrative and explanatory thereof, the various changes in the components, elements, and connections, as well as in the details of the illustrated system may be made without departing from the spirit of the invention.

We claim:

1. A circuit for controlling a bias voltage used to regulate contrast in a video display system capable of operating in a plurality of modes, the circuit comprising:

means for detecting a video mode of the video display system;

means for generating a pulse width modulated signal having a duty cycle, wherein said duty cycle is varied based on said detected video mode, including:

a register for storing a base contrast value;

a register for storing a first offset contrast value;

means responsive to said detected video mode for selectively combining said base and first offset contrast values to produce a final contrast value, wherein said base and first offset contrast values are combined for a first video mode and said base contrast value is used alone for a second video mode; and means responsive to said final contrast value for producing said pulse width modulated signal, wherein said duty cycle of said pulse width modulated signal is proportional to said final contrast value; and means for converting said pulse width modulated signal to the bias voltage, wherein the bias voltage is proportional to the duty cycle of said pulse width modulated signal.

2. The circuit of claim 1, wherein said generating means further includes a register for storing a second offset contrast value, and wherein said means for selectively combining further combines said base and second offset contrast values for a third video mode to produce a final contrast value.

3. The circuit of claim 1, wherein said means for producing said pulse width modulated signal includes:

a counter having a counter output value; and means for comparing said final contrast value and said counter value and providing a signal in a first state when said counter value is less than said final contrast value and in a second state when said counter value is greater than said final contrast value, said signal forming said pulse width modulated signal.

4. The circuit of claim 1, wherein said means for selectively combining performs an arithmetic function on said base and first offset contrast values to produce said final contrast value.

5. The circuit of claim 1, wherein said means for converting said pulse width modulated signal to the bias voltage includes:

an averaging filter receiving a version of said pulse width modulated signal and producing an output signal representative of the average DC level of said pulse width modulated signal; and a voltage regulator receiving said averaging filter output signal and providing the bias voltage as an output.

6. The circuit of claim 5, wherein said means for converting said pulse width modulated signal to the bias voltage further includes:

a thermistor located to monitor the temperature of the video display, said thermistor connected to said voltage regulator to adjust the bias voltage to compensate for temperature changes.

7. A video display system for controlling a bias voltage used to regulate contrast of a video display, the video display system capable of operating in a plurality of modes, the system comprising:

a video controller including:

a mode register for storing the video display mode of the video controller;

means for detecting a video mode of the video controller as contained in said mode register;

means for generating a pulse width modulated signal having a duty cycle, wherein said duty cycle is varied based on said detected video mode, including:

a register for storing a base contrast value;

a register for storing a first offset contrast value;

means responsive to said detected video mode for selectively combining said base and first offset contrast values to produce a final contrast value, wherein said base and first offset contrast values are combined for a first video mode and said base contrast value is used alone for a second video mode; and means responsive to said final contrast value for producing said pulse width modulated signal, wherein said duty cycle of said pulse width modulated signal is proportional to said final contrast value; and means for converting said pulse width modulated signal to the bias voltage, wherein the bias voltage is proportional to the duty cycle of said pulse width modulated signal.

8. The system of claim 7, wherein said generating means further includes a register for storing a second offset contrast value, and wherein said means for selectively combining further combines said base and second offset contrast values for a third video mode to produce a final contrast value.

9. The system of claim 7, wherein said means for producing said pulse width modulated signal includes:

a counter having a counter output value; and means for comparing said final contrast value and said counter value and providing a signal in a first state when said counter value is less than said final contrast value and in a second state when said counter value is greater than said final contrast value, said signal forming said pulse width modulated signal.

10. The system of claim 7, wherein said means for selectively combining performs an arithmetic function on said base and first offset contrast values to produce said final contrast value.

11. The system of claim 7, wherein said means for converting said pulse width modulated signal to the bias voltage includes:

an averaging filter receiving a version of said pulse width modulated signal and producing an output signal representative of the average DC level of said pulse width modulated signal; and a voltage regulator receiving said averaging filter output signal and providing the bias voltage as an output.

12. The system of claim 11, wherein said means for converting said pulse width modulated signal to the bias voltage further includes:

a thermistor located to monitor the temperature of the video display, said thermistor connected to said voltage regulator to adjust the bias voltage to compensate for temperature changes.

13. A computer system, comprising:

a liquid crystal display panel which receives a bias voltage input to control contrast;

a video controller providing video a to said liquid crystal display panel, having a plurality of modes and including:

a mode register for storing the video display mode of the video controller;

means for detecting a video mode of the video controller from said mode register; and means for generating a pulse width modulated signal having a duty cycle, wherein said duty cycle is varied based on said detected video mode including:

a register for storing a base contrast value;

a register for storing a first offset contrast value;

means responsive to said detected video mode for selectively combining said base and first offset contrast values to produce a final contrast value, wherein said base and first offset contrast values are combined for a first video mode and said base contrast value is used alone for a second video mode; and means responsive to said final contrast value for producing said pulse width modulated signal, wherein said duty cycle of said pulse width modulated signal is proportional to said final contrast value; and means for converting said pulse width modulated signal to the bias voltage, wherein the bias voltage is proportional to the duty cycle of said pulse width modulated signal.

14. The computer system of claim 13, wherein said generating means further includes a register for storing a second offset contrast value, and wherein said means for selectively combining further combines said base and second offset contrast values for a third video mode to produce a final contrast value.

15. The computer system of claim 13, wherein said means for producing said pulse width modulated signal includes:

a counter having a counter output value; and means for comparing said final contrast value and said counter value and providing a signal in a first state when said counter value is less than said final contrast value and in a second state when said counter value is greater than said final contrast value, said signal forming said pulse width modulated signal.

16. The computer system of claim 13, wherein said means for selectively combining performs an arithmetic function on said base and first offset contrast values to produce said final contrast value.

17. The computer system of claim 13, wherein said means for converting said pulse width modulated signal to the bias voltage includes:

an averaging filter receiving a version of said pulse width modulated signal and producing an output signal representative of the average DC level of said pulse width modulated signal; and a voltage regulator receiving said averaging filter output signal and providing the bias voltage as an output.

18. The computer system of claim 17, wherein said means for converting said pulse width modulated signal to the bias voltage further includes:

a thermistor located to monitor the temperature of the liquid crystal display, said thermistor connected to said voltage regulator to adjust the bias voltage to compensate for temperature changes.

19. A method for controlling a bias voltage used to regulate contrast in a video display system capable of operating in a plurality of modes, the method comprising the steps of:

detecting a video mode of the video display system;

generating a pulse width modulated signal having a duty cycle, wherein said duty cycle is varied based on said detected video mode, including;

storing a base contrast value;

storing a first offset contrast value;

selectively combining said base and first offset contrast values to produce a final contrast value, wherein said base and first offset contrast values are combined for a first video mode and said base contrast value is used alone for a second video mode; and producing said pulse width modulated signal, wherein said duty cycle of said pulse width modulated signal is proportional to said final contrast value; and converting said pulse width modulated signal to the bias voltage, wherein the bias voltage is proportional to the duty cycle of said pulse width modulated signal.

20. The method of claim 19, wherein said generating step further includes the step of storing a second offset contrast value, and wherein said step of selectively combining further combines said base and second offset contrast values for a third video mode to produce a final contrast value.

21. The method of claim 19, wherein said step of producing said pulse width modulated signal includes the steps of:

counting in a cyclic fashion; and comparing said final contrast value and said cyclic count value and providing a signal in a first state when said cyclic count value is less than said final contrast value and in a second state when said cyclic count value is greater than said final contrast value, said signal forming said pulse width modulated signal.

22. The method of claim 19, wherein said step of selectively combining performs an arithmetic function on said base and first offset contrast values to produce said final contrast value.

23. The method of claim 19, wherein said step of converting said pulse width modulated signal to the bias voltage includes the steps of:

averaging the said pulse width modulated signal and producing an output signal representative of the average DC level of said pulse width modulated signal; and providing a regulated signal as the bias voltage, said regulated signal based on said averaged output signal.

24. The method of claim 23, wherein said step of converting said pulse width modulated signal to the bias voltage further includes the step of monitoring the temperature of the video display and adjusting the bias voltage to compensate for temperature changes.

* * * * *

UNITED STATES PATENT AND TRADEMARK OFFICE

CERTIFICATE OF CORRECTION

PATENT NO. : 5,534,889
DATED : July 9, 1996
INVENTOR(S) : Daniel B. Reents et al.

It is certified that error appears in the above-identified patent and that said Letters Patent is hereby corrected as shown below:

Column 12,
Line 54, after "video" delete "a" and insert therefor -- data --.

Signed and Sealed this

Twenty-second Day of November, 2005

JON W. DUDAS
*Director of the United States Patent and Trademark Office*